US005926881A

United States Patent [19]

Madison

[11] Patent Number: 5,926,881

[45] Date of Patent: Jul. 27, 1999

[54] COMBINATION ACCESSORY BAG AND DIAPER CHANGING TABLE

[76] Inventor: Santosha B. Madison, 2780 Valley Ridge Dr., Decatur, Ga. 30032

[21] Appl. No.: 09/108,021

[22] Filed: Jun. 30, 1998

[51] Int. Cl.[6] ..... A47C 20/02

[52] U.S. Cl. ..... 5/655; 5/416; 190/2

[58] Field of Search ..... 5/655, 99.1, 416, 5/97; 190/2, 1, 109

[56] References Cited

U.S. PATENT DOCUMENTS

| | | | |
|---|---|---|---|
| D. 367,771 | 3/1996 | Julian | 5/655 X |
| 2,695,412 | 11/1954 | Kunz | 5/99.1 |
| 3,269,621 | 8/1966 | Dishart | 224/585 |
| 3,721,434 | 3/1973 | Spies | 5/655 |
| 3,968,911 | 7/1976 | Haas | 224/158 |
| 4,133,063 | 1/1979 | Jones-Steele | 5/99.1 |
| 4,143,434 | 3/1979 | Monot | 5/99.1 |
| 4,172,300 | 10/1979 | Miller | 5/424 |
| 4,205,669 | 6/1980 | Hamann | 5/603 |
| 4,216,951 | 8/1980 | Griffen | 5/655 |
| 4,716,258 | 12/1987 | Eves | 136/246 |
| 4,965,896 | 10/1990 | Berger et al. | 5/424 |
| 4,999,863 | 3/1991 | Kane | 5/99.1 |
| 5,035,013 | 7/1991 | Bloom | 5/420 |
| 5,161,270 | 11/1992 | Najmabadi | 5/424 |
| 5,187,826 | 2/1993 | Mariol | 5/655 |
| 5,215,172 | 6/1993 | Stevenson | 190/2 |
| 5,297,305 | 3/1994 | Williams | 5/655 |
| 5,299,336 | 4/1994 | Marteeny | 5/655 |
| 5,464,381 | 11/1995 | Wilson | 601/49 |
| 5,473,785 | 12/1995 | Lager et al. | 5/655 |
| 5,615,433 | 4/1997 | Martin | 5/655 |

*Primary Examiner*—Brian K. Green
*Assistant Examiner*—Rodrigo J. Morales
*Attorney, Agent, or Firm*—Kenneth L Tolar

[57] ABSTRACT

A combination carrying case and diaper changing table includes a pair of pivotally joined shell portions which mate in a clam shell fashion to form a hollow carrying case. Each portion includes a pair of side walls and outer and inner end walls therebetween defining a storage space. The shell portions may be opened to expose a cushion to form a diaper changing table. A first section has an outer barrier surrounding its side and outer end walls forming a substantially U-shaped receptacle therebetween. A canopy is collapsibly received within the storage receptacle which may be expanded to form a light or privacy screen. A side rail is secured to the inwardly facing side of each shell portion side wall which may be pivoted to a vertical position when the shell portions are in an open position providing a protective barrier about the diaper changing table.

6 Claims, 1 Drawing Sheet

COMBINATION ACCESSORY BAG AND DIAPER CHANGING TABLE

BACKGROUND OF THE INVENTION

The present invention relates to an accessory bag that is easily convertible to a diaper changing table with safety rails and a canopy.

DESCRIPTION OF THE PRIOR ART

When changing an infant's diaper, it is convenient to lay the infant on an elevated, planar surface. However, when changing a diaper in public, a parent must place the infant on a bench, bathroom counter or even the ground which is unsanitary and uncomfortable for the infant. Laying the child on an elevated surface is dangerous since the child can easily slip or fall resulting in serious injury. Furthermore, a parent often wishes to conceal the child from public view.

In addition to the above described problems, a parent must typically transport various items such as pacifiers, bottles, diapers and toys which is cumbersome and inconvenient. Accordingly, there is currently a need for a device capable of transporting various accessory items that may be interchangeably converted to a sanitary, comfortable and safe diaper changing surface.

Various diaper changing tables and accessory carriers exist in the prior art. For example, U.S. Pat. No. 5,473,785 issued to Lager et al relates to a traveling, collapsible toddler bed including a rectangular sheet having a plurality of pockets along the edges thereof. Plastic foam boards are insertable into the pockets which are folded upwardly to form a walled bed.

U.S. Pat. No. 5,464,381 issued to Wilson relates to an infant soothing seat including a sound and motion mechanism.

U.S. Pat. No. 5,297,305 issued to Williams relates to a changing table convertible into a youth bed and play table.

U.S. Pat. No. 5,215,172 issued to Stevenson relates to a portable infant care platform including first and second members which are hingedly movable relative to each other. The members may be laid flat to form a platform, seat or a bed.

U.S. Pat. No. 5,187,826 issued to Mariol relates to a cradle convertible between a seat and a bed.

U.S. Pat. No. 5,615,433 issued to Martin relates to a combination diaper bag and portable changing table having a diaper changing surface which draws, filters and then exhausts air therefrom.

U.S. Pat. No. 5,161,270 issued to Najmabadi relates to a changing apparatus comprising a mattress having a separator means thereon for preventing a person from touching his or her lower extremities.

U.S. Pat. No. 4,133,063 issued to Jones-Steele relates to a portable infant changing table including a pair of articulated mattress sections which may be folded to a compact, portable configuration. The device also includes safety side board members and one or more pockets at the outwardly facing surfaces of the mattress sections to facilitate carrying of baby related articles.

The present invention solves the above enumerated problems by providing a carrying case that may be opened to form a diaper changing table. Side rails may be pivoted upwardly to provide a barricade about the diaper changing table and a canopy may be extended from an end of the table to provide a private enclosure therefor.

SUMMARY OF THE INVENTION

The present invention relates to a combination carrying case and diaper changing table. The device comprises two hollow hingedly joined shell portions movable between an open, substantially flat position and a closed position to form a carrying case. In an open position, the two sections support a foam cushion that provides a diaper changing table. Pivotally secured to a side of each shell section is a rail member which may be pivoted to a vertical position when the changing table is in use, preventing an infant from sliding or rolling off the cushion. A first shell section has an outer barrier that forms a substantially U-shaped receptacle therebetween for receiving a collapsible canopy member. The canopy member may be expanded to provide a privacy or light screen above the cushion. The opposing shell section has a pair of opposing drawers slidably received therein for storing various accessory items. It is therefore an object of the present invention to provide a combination accessory bag and changing table having foldable guard rails preventing a child from sliding off the table.

It is yet another object of the present invention to provide a combination accessory bag and changing table having an expandible canopy for privately changing an infant's diaper.

It is yet another object of the present invention to provide an accessory bag that may be quickly and conveniently converted to a diaper changing table. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
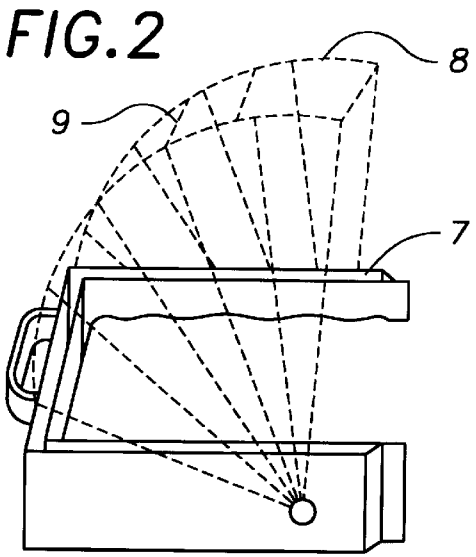
FIG. 2 depicts the canopy according to the present invention.
Figure 3:
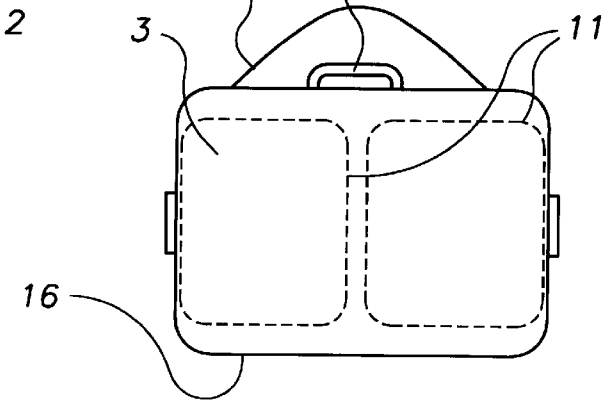
FIG. 3 depicts the carrying case in a closed position.
Figure 1:
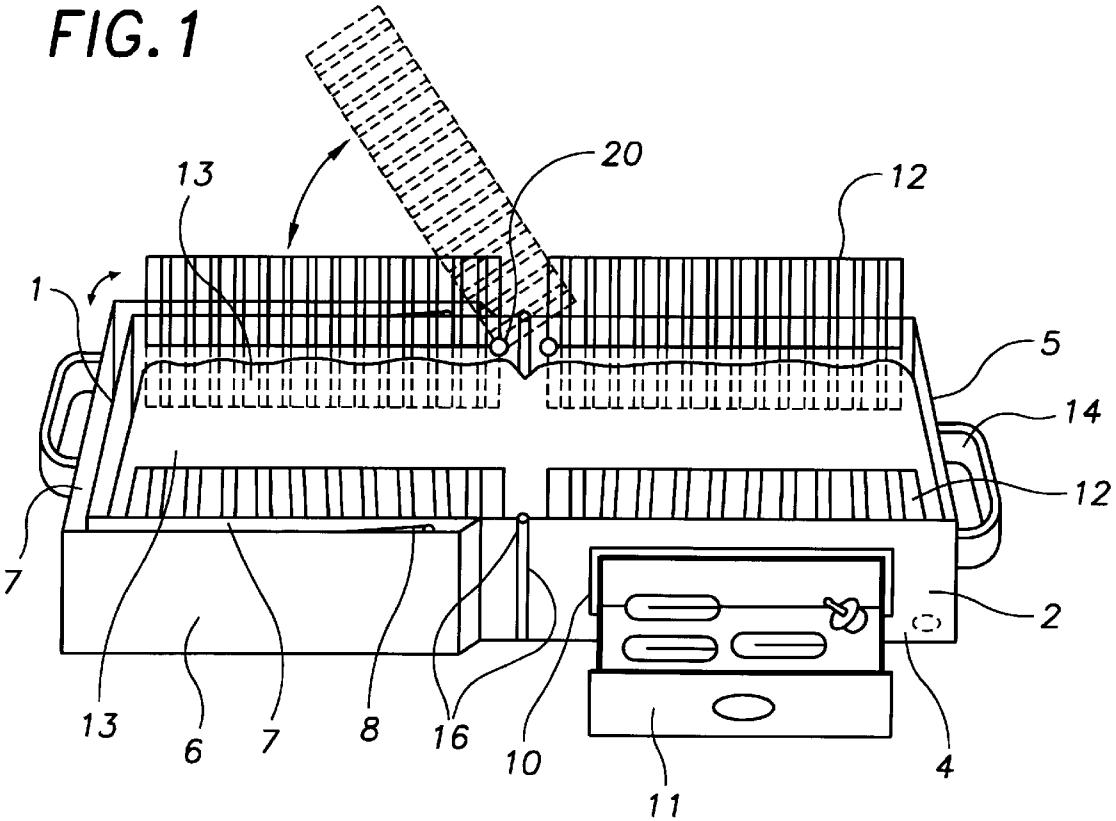
FIG. 1 depicts the carrying case according to the present invention in an open position to form a diaper changing table.

Referring now to FIGS. 1 through 3, the present invention relates to a carrying case which may be converted to a diaper changing table. The device comprises two hingedly joined shell portions 1, 2 movable between an open and closed position in a clam shell fashion. Each shell portion includes a bottom wall 3 with a pair of opposing side walls 4, an outer end wall 5 and an inner end wall 16 perpendicularly depending therefrom. The area between the side and end walls defines a storage space therebetween.

A first shell portion 1 has an outer barrier 6 formed from three adjoining panels each substantially parallel to a wall of the shell portion. The area between the outer barrier 6 and the shell portion defines a substantially U-shaped storage receptacle 7. Received within the storage receptacle is a collapsible canopy member 8 which may be expanded to provide a privacy or light screen. The canopy is supported with a plurality of U-shaped frame members 9, the terminal ends of which are pivotally joined to the outwardly facing sides of the shell portion side walls.

The opposing side walls of the second shell portion 2 each have an opening 10 with a drawer 11 slidably received therein for storing and retaining accessory items. Attached to the inner surface of each side wall is a rail 12 movable between a horizontal and a vertical position. An end of each side rail, preferably that adjacent the shell portion inner end wall is attached to the side wall with a pivotable C-clamp 20. The C-clamp allows the opposing end of the rail to be pivoted upright when placing an infant on the cushion. The side rail may also rotate within the C-clamp allowing the rail to be folded inwardly to lay the rail flat when closing the shell sections.

Within the interior of the storage space is an elongated foam cushion 13 defining a horizontal diaper changing table when the shell sections are in an open position. The cushion extends from one shell portion outer end wall to the other outer end wall and preferably has a protective layer of vinyl on its upper surface.

Each shell portion outer end wall has a U-shaped handle 14 extending therefrom for assisting a user in carrying the device. A shoulder strap 15 may be attachable to either outer end wall for further assisting a user in transporting the device.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A combination accessory bag and diaper changing table comprising:

a first and a second hollow shell portion each hingedly joined together allowing said portions to move between an open and a closed position, each portion including at least one inwardly facing side;

a foam cushion received within said shell portions that provides a flat diaper changing surface when said shell portions are in said open position;

a side rail pivotally secured to the inwardly facing side of each shell portion, each said side rail pivotable between a horizontal and vertical position to form a protective barricade around said diaper changing surface;

an outer barrier surrounding the first shell portion, an area between which defines a storage receptacle;

a canopy member collapsibly received within said storage receptacle and extendable therefrom to provide a light and privacy screen suspended above said diaper changing surface.

2. A combination accessory bag and diaper changing table according to claim 1 wherein the second shell portion further comprises an opening having a drawer slidably received therein for storing accessory items.

3. A combination accessory bag and diaper changing table according to claim 1 further comprising a handle extending from each shell section.

4. A combination accessory bag and diaper changing table according to claim 1 further comprising a shoulder strap removably secured to one of said shell portions.

5. A combination accessory bag and diaper changing table according to claim 1 wherein said cushion further comprises an upper surface having a protective layer thereon.

6. A combination accessory bag and diaper changing table according to claim 1 wherein an end of each side rail is pivotable upwardly to assist a user in placing a child on said cushion and removing the child therefrom.

* * * * *